US006354451B1

(12) United States Patent
Holst

(10) Patent No.: US 6,354,451 B1
(45) Date of Patent: Mar. 12, 2002

(54) FREIGHT CONTAINER

(75) Inventor: Preben Holst, Egernsund (DK)

(73) Assignee: Maersk Container Industri AS (DK)

( * ) Notice: Subject to any disclaimer, the term of this patent is extended or adjusted under 35 U.S.C. 154(b) by 0 days.

(21) Appl. No.: 09/680,354

(22) Filed: Oct. 5, 2000

(51) Int. Cl.[7] ..... B65D 6/28; B65D 88/00
(52) U.S. Cl. ..... 220/1.5; 220/652
(58) Field of Search ..... 220/1.5, 652, 608, 220/643, 651, 682, 692

(56) References Cited

U.S. PATENT DOCUMENTS

| | | | | | |
|---|---|---|---|---|---|
| 186,747 | A | * | 1/1877 | Munzinger | 220/652 |
| 752,466 | A | * | 2/1904 | Pement | 220/652 |
| 961,522 | A | * | 6/1910 | Neblett | 220/652 |
| 3,112,044 | A | * | 11/1963 | Larsen et al. | 220/652 |
| 4,046,186 | A | | 9/1977 | Nordstorm | 160/368 R |
| 4,212,406 | A | | 7/1980 | Mittelmann | 220/1.5 |
| 4,429,730 | A | | 2/1984 | Elston | 160/368 R |
| 4,538,663 | A | | 9/1985 | Looker | 160/368 R |
| 5,109,998 | A | | 5/1992 | Bretschneider | 220/1.5 |
| 5,178,292 | A | * | 1/1993 | Korzenlowski | 220/652 |
| 5,601,201 | A | | 2/1997 | Looker | 220/1.5 |
| 5,829,615 | A | * | 11/1998 | Rickinger et al. | 220/652 |

FOREIGN PATENT DOCUMENTS

DE 2713125 10/1977

OTHER PUBLICATIONS

Danish Instruction Manual, "Installation of Gardinstaenger"; Prior To Oct. 5, 1999.

* cited by examiner

*Primary Examiner*—Joseph M. Moy
(74) *Attorney, Agent, or Firm*—Ladas & Parry

(57) ABSTRACT

The invention relates to a freight container (1) having sides (10, 20) oriented perpendicularly to each other and defining an internal cargo space, and having a rectangular access opening which allows access to said cargo space, said access opening being surrounded by straight sections of a groove (43), said sections being oriented perpendicularly to each other, said groove (43) extending in a plane which is substantially parallel with the access opening, said freight container (1) having separate groove connection devices (50) with a groove (51) which has a cross-sectional shape corresponding to the groove (43), and which forms a continuously extending smooth transition between two adjoining sections of the groove (43).

12 Claims, 4 Drawing Sheets

FREIGHT CONTAINER

Figure 1:
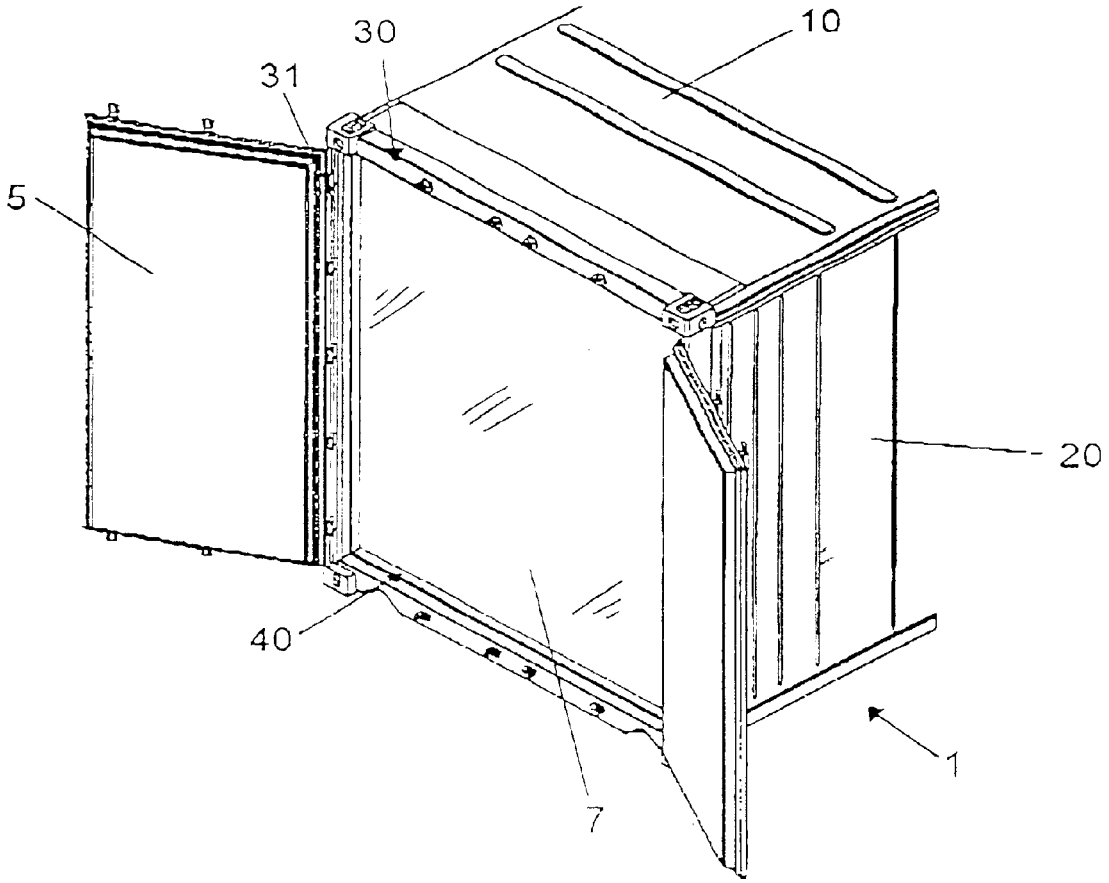

The present invention relates to a freight container having sides oriented perpendicularly to each other and defining an internal cargo space, and having an access opening allowing access to said cargo space, said access opening being surrounded by substantially straight sections of a channel-shaped first groove, said sections being oriented perpendicularly to each other, said groove extending in a plane which is substantially parallel with the access opening.

Such a container is already known, wherein the groove is formed in a separate and elongated strip-shaped component, which is secured to the surface of the container, and which forms an uninterrupted groove that extends along the circumference of the access opening. It is hereby possible to secure a sheet across the access opening, the edges of the sheet being inserted into the groove for subsequent fixing by means of a plastics strip that is pressed into the groove. The groove has a curved extent at the corners of the access opening to ensure a tight connection between the sheet and the groove at the corners of the access opening.

The invention provides a simplified solution, as the freight container need only be provided with separate and straight sections of said groove along each of the sides of the access opening. These sections may e.g. be formed integrally with the sides of the freight container. By mounting separate groove connection devices with a second groove which has a cross-sectional shape essentially corresponding to the cross-sectional shape of the first groove, and which forms a continuously extending smooth transition between the straight sections of the first groove, it is possible, in a simple manner, to ensure the tight connection at the openings of the access opening where the straight sections of the groove meet. Because of the smooth transition, the plastics strip, which has a shape adapted to the cross-section of the first groove, may be received in a continuously extending, annular groove which has a uniform cross-section, without being given sharp bends.

According to a preferred embodiment, the groove connection devices comprise engagement means which are shaped complementarily to the channel-shaped groove, and which are adapted to provide a mechanical engagement with two adjoining sections of the groove. Hereby, the groove connection devices may be mounted in a simple manner, and it is possible to replace damaged groove connection devices in a simple manner.

It is particularly preferred that the groove connection devices having a curved groove which forms a curved transition between the straight sections of the groove.

According to a particularly advantageous embodiment of the invention, the groove connection devices comprise a first part adapted to be engaged with the first groove and a second part adapted to prevent subsequent removal of the first part from the groove, and locking means for allowing releasable retention of the second part relative to the groove.

In those cases where the groove is formed with an approximately symmetrical cross-section owing to the attachment of the strip, the groove connection devices may advantageously be formed as stated in claim 7.

Further, advantageous embodiments of the invention are defined in the dependent claims.

The invention will now be explained more fully below with reference to the embodiment shown in the drawing.

Figure 2:
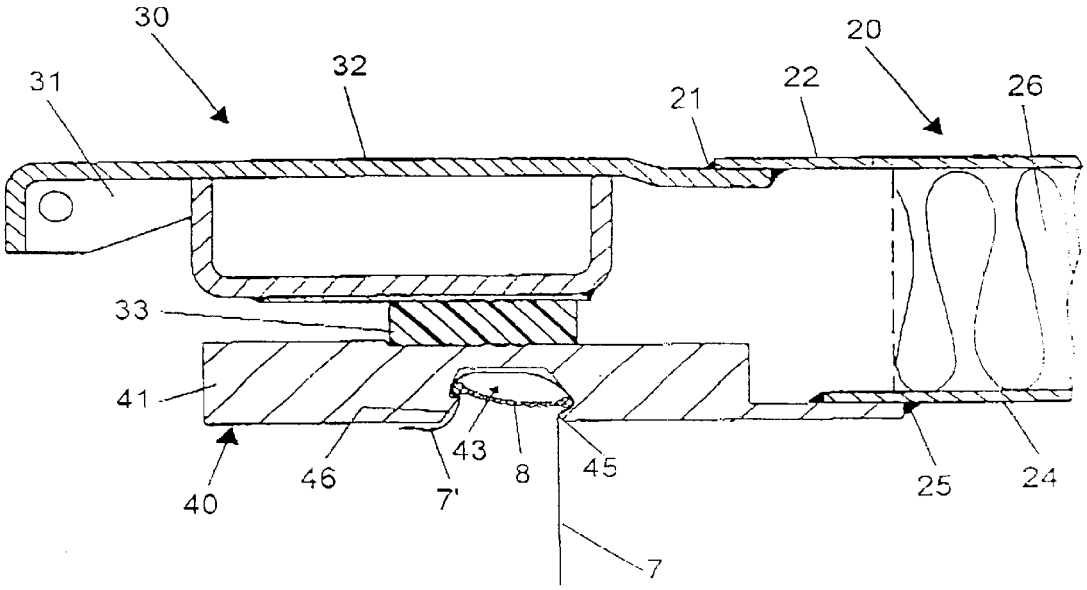
Figure 3:
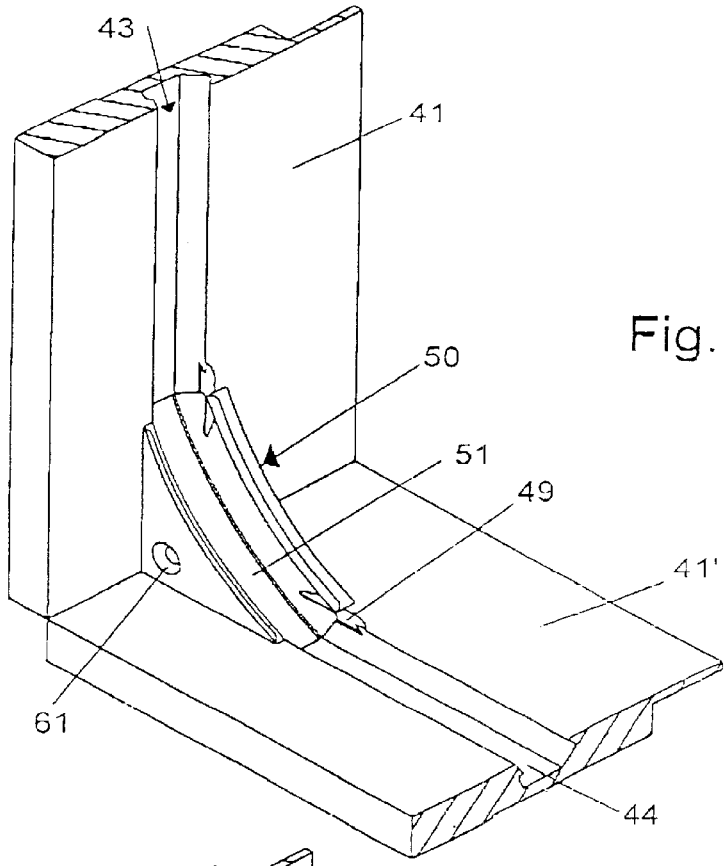
Figure 4:
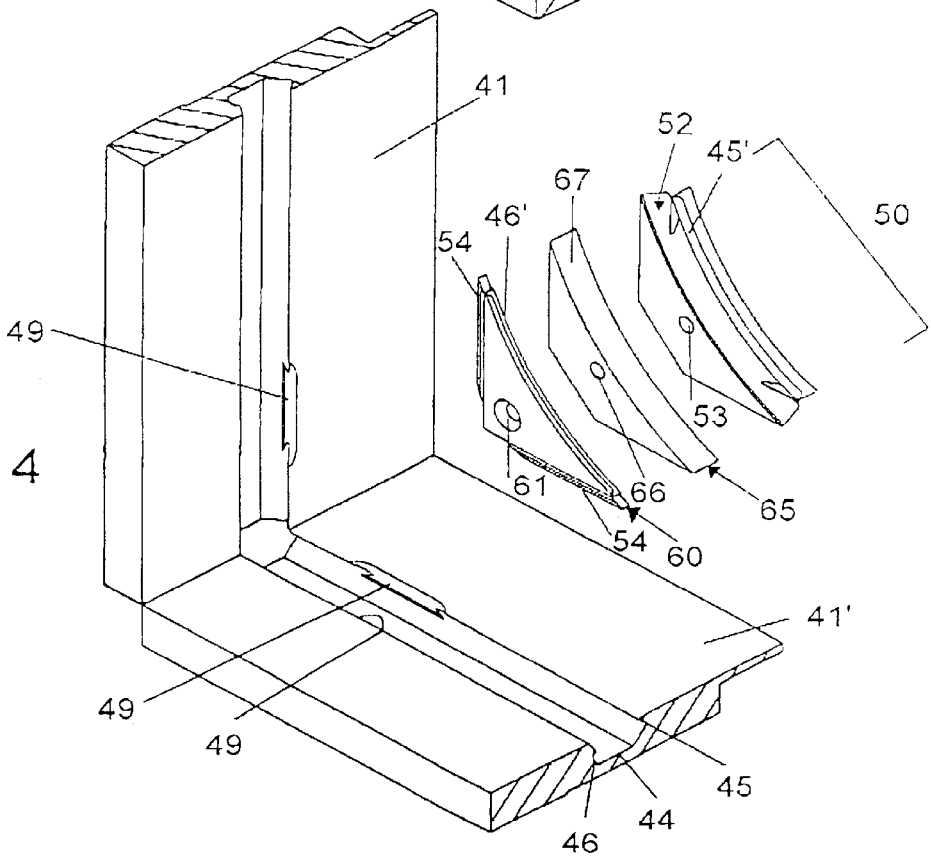
Figure 5:
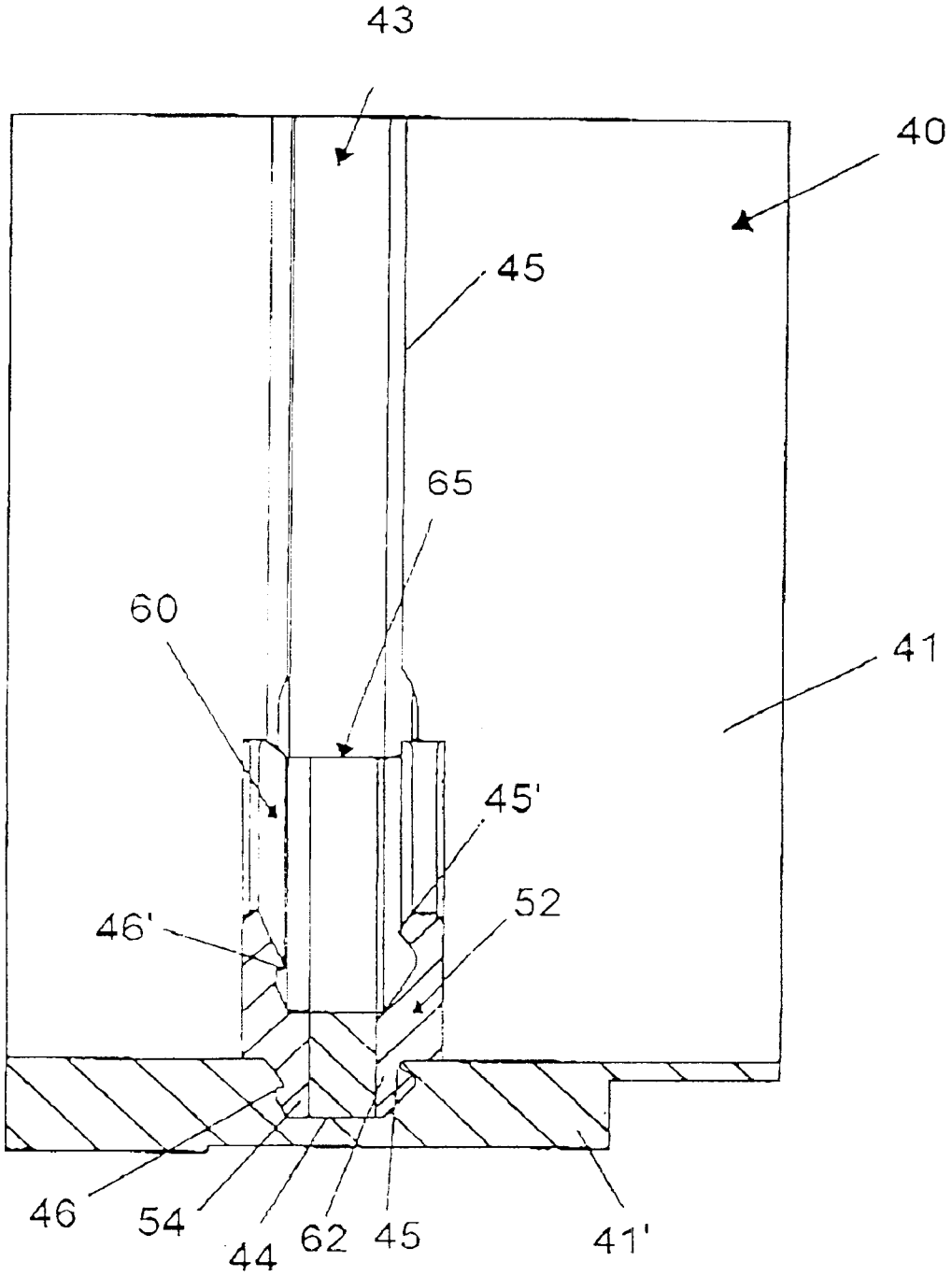

FIG. 1, seen from the access opening, shows part of a freight container which is sealed by a sheet that extends across the access opening, FIG. 2 shows a horizontal cross-section through the left vertical frame or the freight container in FIG. 1, in the area at the access opening, FIG. 3 shows a detailed view of the joint between two frame elements that are incorporated in the freight container shown in FIG. 1, FIG. 4 shows a partially exploded view of the corner joint shown in FIG. 3, and FIG. 5 shows a vertical cross-section through the joint shown in FIG. 3.

In FIG. 1, the Reference numeral 1 shows the end of an elongated freight container which, in the embodiment shown, is provided with a cooling device (not shown) or establishing a desired temperature interiorly In the freight container The freight container 1 has sides in the form of parallel and vertical walls 20, a horizontal bottom, a horizontal ceiling 10 and an end wall (not shown). In the example, the freight container 1 has two annular vertical frames 30, 40 at the shown end which together define an access opening to the freight container 1. This access opening may be closed by means of doors 5 which are secured to the outer frame 30 of the two Frames by means of hinges 31, the other frame 40 of the two frames being arranged internally in the first-mentioned frame 30.

The doors 5, together with the sides 10, 20 and the end wall, are preferably provided with a suitable insulation for maintaining the desired temperature in the interior of the freight container. Furthermore, the freight container 1 is provided with a flexible plastics sheet 7 which extends across the access opening, and which greatly seals the atmosphere in the freight container 1 from the outside when the doors 5 are closed, in a conventional manner.

FIG. 2 shows an enlarged view of a horizontal cross-section through one vertical wall 20 of the freight container 1, more particularly the wall which is not visible in FIG. 1. It appears that the wall 20 has an outer cladding 22 and an inner cladding which has an inner surface 24 directed towards the interior of the freight container 1. An insulating material 26, preferably a foamed material, is arranged between the outer cladding 22 and the inner cladding. A vertically extending element 32 of the frame 30 is connected with the outer cladding 22 via a weld 21, and the inner cladding is connected via a weld 25 with a vertical frame element 41 which is incorporated in the frame 40. It will be appreciated that the figure merely represents a preferred embodiment where the two frames 30, 40 are movably interconnected by a gasket 33, as is described in European Patent No. 731 768 which is hereby incorporated in the present text by way of reference.

FIG. 2 moreover shows that the surfaces facing inwards toward the interior of the container 1 are formed with an elongated channel-shaped first groove 43 which is defined outwardly by two locking flanges 45, 46. The locking flanges 45, 46 define a longitudinal access passage to groove 43 which, as shown, expands immediately behind the locking flanges 45, 46, and preferably converge again in a direction toward the bottom of the groove 43. As shown, the groove 43 may be formed integrally with the frame element 41 in the internal frame 40 and preferably extends uninterruptedly around the entire access opening. Alternatively, the groove 43 may be formed in the inner cladding at a desired distance from the access opening, or the groove 43 may be formed in the frame 30, e.g if an internal frame 40 is not used. Further, if desired, the groove may he formed so that the access passage is oriented in a direction toward the access opening.

As shown, the groove 43 serves to fix the edge 7' of the above-mentioned sheet 7 in the access opening in a conventional manner, there being used a flexible strip 8 of a plastics material for this purpose which is pressed into the groove 43 after insertion of the edge 7' in the groove 43. The shape of the groove 43 behind the locking flanges 45, 46 may be selected to facilitate this pressing-in. The strip 8 preferably has a length corresponding to the perimeter of the access opening, and the strip 8 may be pulled out to release the sheet 7 when access to the interior of the freight container 1 is desired.

FIG. 3 shows an internal corner of the frame 40, where the vertical frame element 41 shown in FIG. 2 is connected, e.g. by welding, with a corresponding horizontal frame element 41' which is intended to be connected with the bottom of the freight container. It will be seen that the two frame elements 41 and 41' are interconnected via a groove connection device 50, which may be adapted to impart a certain rigidity to the joint of the frame elements 41, 41'. More particularly, the groove connection device 50 is secured to the groove 43 in a releasable manner, and at the top the groove connection device 50 has a curved groove 51 which is shaped so as to form, a continuous transition between the groove 43 extending on the vertical frame element 41 and the groove 43 extending on the horizontal frame element 41'. More particularly, the second groove 51 has essentially the same profile as the groove 43, and the groove connection device 50 may thus receive the sheet 7 and the strip 8 at the shown point. It appears that, according to the shape of the groove 43, the locking flanges 45, 46 in the frame elements 41, 41' may also be provided with recesses 49 which, to a greater extent, allow unobstructed insertion of the strip 8 at the transition between the groove 43 in the frame elements 41, 41' and the groove 51 of the groove connection device 50. Because of the curved extent of the groove 51 it is ensured that the strip 8 is not given a sharp bend.

In FIG. 4, the groove connection device 50 is Shown in greater detail, and it appears that the groove connection device 50 is composed of three separate parts, via a first part 52, a second part 65 and a third part 60. Each of these parts has a through hole 53, 66 and 61, respectively, and the three parts may be interconnected by means of a pin (not shown) that may be passed through the holes 53, 61 and 66 when the parts are arranged side by side as shown in FIG. 3. Each of the parts 52, 65 and 60 has a curved side edge, and these curved side edges together form the curved upper groove 51 of the groove connection device 50. The first part 52 and the third part 60 are provided with hooklike projections 54, 62, by means of which these parts may be caused to engage the groove 43, and with locking flanges 45', 46' of a shape corresponding to the shape of the locking flanges 45, 46 of the groove 43. The hook-like projections 54, 62, which will be seen more clearly in FIG. 5, are arranged along each of the two edge sides of the parts 52, 60 which extend along the vertical frame element 41 and the horizontal frame element 41', respectively. The first part 52 and the second part 60 may moreover be provided with incisions that serve the same purpose as the recesses 49.

In FIG. 5, the groove connection device 50 is shown in the mounted state, where the groove connection device 50 is kept engaged with the groove 43 on the horizontal frame element 41' as well as the vertical frame element 41. It will be seen here how the locking hooks 62, 54 on the first part and the third part, respectively, of the groove connection device 50 are engaged with the locking flanges 45, 46 which define the horizontal and the vertical groove 43 outwardly.

The mounting of the grove connection device in the groove 43 is more particularly carried out in that the first part 52 is inserted into the groove via the access passage between the locking flanges 45, 46 and are moved laterally, so that the locking hook 54 of the part engages the rear side of the locking flange 45 of the groove 43, both in the vertical frame element 41 and in the horizontal frame element 41'. The third part 60 is inserted into the groove 43 in a corresponding manner. Then, the second part 65 of the groove connection device 50 is inserted into the space between the first part 52 and the third part 60. The second part 65 is preferably formed with a width corresponding to the space. In this position, the first part 52 and the third part 60 are prevented from being moved laterally backwards. The second part 65 is finally fixed by means of the above-mentioned transverse pin, which is inserted through the holes 53, 61, 66 and is secured, e.g. by means of a nut. It should be stressed that the second part 65 may very well be fixed in another manner, e.g. by snapping on.

Although, as explained above, the invention primarily serves to provide a groove for retaining the mounting strip 8 at the inner corners of the freight container 1, it is clear that the groove connection device 50 may also be used for imparting increased strength to the frame 40 at the corners, and that, in this case, the groove 43 may merely be necessary in the area at the corners of the freight container 1. The groove 43 in the frame elements 41, 41' may also be provided with stops that prevent relative displacement of the locking device 50 relative to the frame elements. It is hereby possible to connect the frame elements 41, 41' solely because of the engagement between the locking hooks 54 and the locking flanges 45, 46.

What is claimed is:

1. A freight container (1) having sides (10, 20) oriented perpendicularly to each other and defining an internal cargo space, and having a rectangular access opening which allows access to said cargo space, said access opening being surrounded by straight sections of a channel-shaped first groove (43), said sections being oriented perpendicularly to each other, said first groove (43) extending in a plane which is substantially parallel with the plane of the access opening, said freight container (1) having separate groove connection devices (50) with a secondgroove (51) which has a cross-sectional shape corresponding to the first groove (43), and which forms a continuously extending smooth transition between two adjoining sections of the first groove (43).

2. A freight container according to claim 1, wherein the groove connection devices (50) comprise engagement means which are shaped complementarily to the first groove (43), and which are adapted to provide a mechanical engagement with two adjoining sections of the first groove (43).

3. A freight container according to claim 2, wherein the second groove (51) forms a curved transition between said sections of the first groove (43).

4. A freight container according to claim 1, wherein, in cross-section, the first groove (43) has a locking flange (45) which defines an access passage to the first groove (43), and wherein the groove connection device (50) comprises:

a first part (52) which is adapted to be moved into the first groove (43) through said access passage and laterally forwards to a locking position in which the first part (52) is in engagement with the locking flange (45), a second part (65) which, in said locking position, is adapted to prevent removal of the first part (52) through the access passage, and locking means to allow a preferably releasable retention of the second part (65) relative to the first groove in said locking position.

5. A freight container according to claim 4, wherein the second part (65) is adapted to engage the first part (52) and a surface of the first groove (43), respectively, in said locking position.

6. A freight container according to claim 4, wherein the locking means are shaped as an elongated pin which extends through the first part (52) and the second part (65).

7. A freight container according to claim 4, wherein the first groove (43) has an additional locking flange (46), said access passage to the first groove (43) extending between the first-mentioned locking flange (45) and the additional locking flange (46), and wherein the groove connection device (60) comprises a third part (60 which is adapted to be moved into the first groove (43) through said access passage and laterally forwards to a locking position in which the third part (60) is engaged with a locking flange (46), said second part (65) being adapted to prevent removal of both the first part (52) and the third part (60) through the access passage in said locking position.

8. A freight container according to claim 7, wherein the first part (52) and the third part (60) comprise protruding locking hooks (54, 62) adapted to engage the locking flanges (45, 46) in said locking position, and wherein the second part (60) is adapted to retain the first part (52) and the third part (60) at a fixed mutual distance in said locking position.

9. A freight container according to claim 1, wherein the first groove (43) is arranged near the access opening.

10. A freight container according to claim 1, wherein the access opening is surrounded by a separate frame (40) connected with at least one of said sides (10, 20), and wherein the frame (40) carries the first groove (43).

11. A freight container according to claim 10, wherein the first groove (43) is formed integrally with the frame (40) by extrusion.

12. A freight container according to claim 1, wherein the groove connection devices (50) are dimensioned to impart a substantial rigidity to the freight container (1) at the connection between the sides (10, 20).

* * * * *